United States Patent [19]

Green

[11] 4,422,345

[45] Dec. 27, 1983

[54] TWO-WAY CONTROL LEVER ROTATABLE IN CAB WALL FOR SOUND SEALING

[75] Inventor: Merlin G. Green, Dubuque, Iowa

[73] Assignee: Deere & Company, Moline, Ill.

[21] Appl. No.: 301,166

[22] Filed: Sep. 11, 1981

[51] Int. Cl.[3] ..... G05G 9/04

[52] U.S. Cl. ..... 74/471 XY

[58] Field of Search ..... 74/471 R, 471 XY; 137/636.2; 200/6 A

[56] References Cited

U.S. PATENT DOCUMENTS

| | | | |
|---|---|---|---|
| 2,929,258 | 3/1960 | Mackway | 74/471 XY |
| 3,095,754 | 7/1963 | Mayon et al. | 74/471 XY |
| 3,179,755 | 4/1965 | Burnham | 74/471 XY |
| 3,757,597 | 9/1973 | Vogel et al. | 74/471 XY |
| 3,765,500 | 10/1973 | Reeves | 180/77 |
| 4,027,547 | 6/1977 | Rahman et al. | 137/636.2 X |

*Primary Examiner*—Allan D. Herrmann

[57] ABSTRACT

A two-way control lever includes a pair of shafts journalled in a cab wall for transmitting motion from a handle of the lever to control functions located exteriorly of the cab. The pair of shafts and their support bearings adequately seal holes provided in a cab wall section for their installation for preventing the transmission of noise therethrough.

2 Claims, 1 Drawing Figure

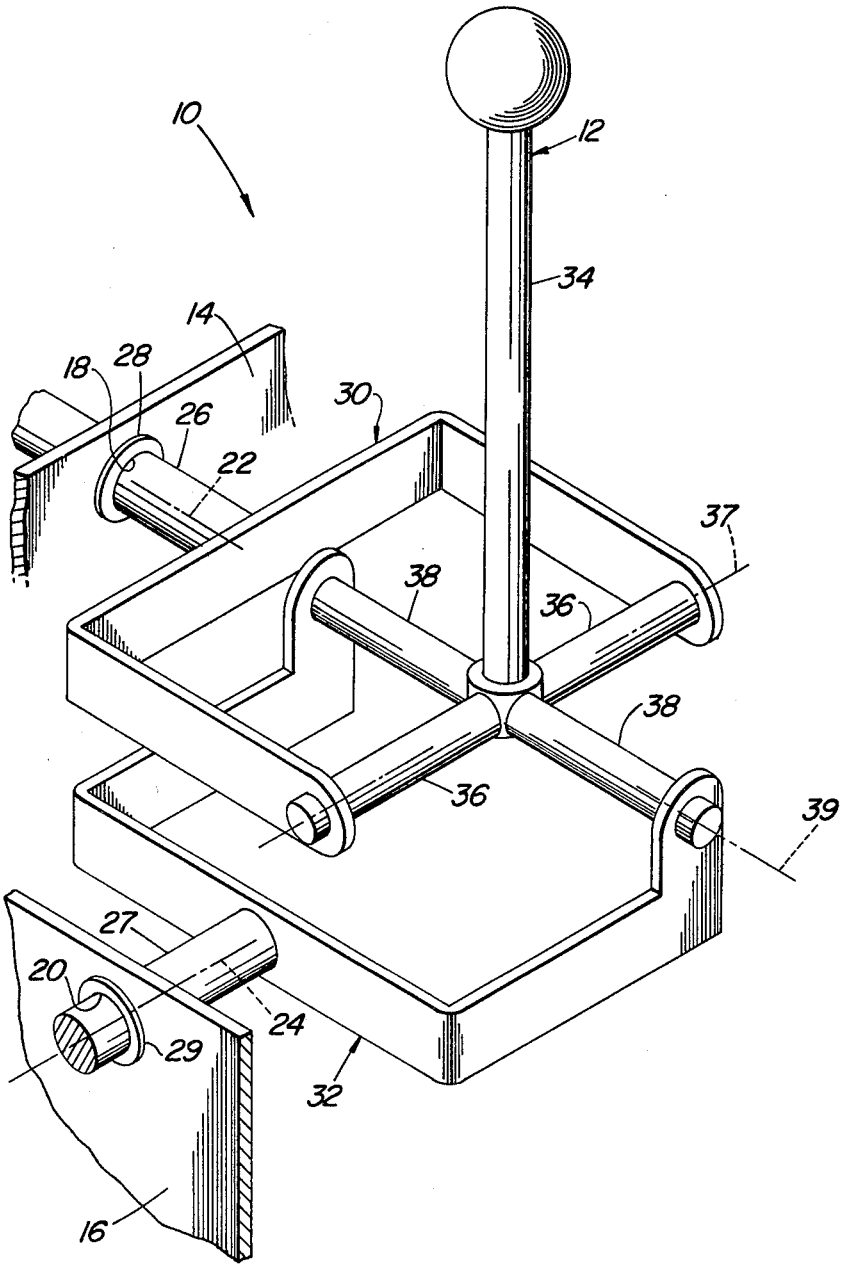
10
12
34
14
18
28
26
22
30
37
38
36
38
36
39
27
20
24
29
32
16

TWO-WAY CONTROL LEVER ROTATABLE IN CAB WALL FOR SOUND SEALING

BACKGROUND OF THE INVENTION

The present invention relates to control levers and more particularly relates to control levers used within cabs for effecting control of devices outside of cabs.

One of the most effective methods of noise reduction in a vehicle cab is the complete closing of all openings between noise sources and an operator in the cab. One area required to be closed or sealed is around control levers or their associated linkage which pass through the cab walls.

This closing or sealing has historically been done, especially in the case of control levers having two degrees of freedom, with the use of rubber boots or slits in foam in which the levers or linkage travel. This method is not always effective due to loose fits or worn parts.

SUMMARY OF THE INVENTION

According to the present invention, there is provided a two-way control lever mounted in a cab in a novel manner.

An object of the invention is to provide a two-way control lever within a cab and mounted so as to control functions located exteriorly of the cab with the parts of the lever which penetrate the cab wall being adequately sealed without the need for rubber boots or foam.

A more specific object is to provide a lever having two degrees of freedom and having a pair of output shaft sections rotatably mounted in the cab wall for transferring control lever movements to functions located exteriorly of the cab.

These and other objects will become apparent from a reading of the ensuing description together with the appended drawing.

BRIEF DESCRIPTION OF THE DRAWING

The sole FIGURE is a perspective view of a two-way control lever and cab wall combination constructed according to the principles of the present invention.

DESCRIPTION OF THE PREFERRED EMBODIMENT

Referring now to the drawing, there is shown a cab wall section 10 and a control lever 12 located within the cab. The wall section 10 includes a pair of vertical wall portions 14 and 16, respectively, which run perpendicular to each other. The wall portions 14 and 16 are respectively provided with holes 18 and 20 which are disposed along horizontal axes 22 and 24 which are located in vertical planes that intersect within the cab.

The lever 12 includes first and second shafts 26 and 27 which are respectively rotatably mounted in bearings 28 and 29 respectively provided in the holes 18 and 20. Secured to the shaft 26 is a yoke 30 and secured to the shaft 27 is a yoke 32. An upright control handle 34 is located centrally between the legs of the yokes 30 and 32 and has a first pair of oppositely projecting stub shafts 36 rotably mounted in the yoke 30 for rotation about an axis 37 located in the vertical plane that contains the axis 24, and has a second pair of oppositely projecting stub shafts 38 rotatably mounted in the yoke 32 for rotation about an axis 39 located in the vertical plane that contains the axis 22.

It will be appreciated then that the shaft 26 may be rotated to control a function connected thereto by moving the control handle 34 in a direction crosswise to the axis 39. The lever then will rotate about the axis 22 to effect rotation of the shaft 26 without imparting any motion to the shaft 27. Similarly, movement of the handle 34 in a direction crosswise to the axis 37 will result in the handle rotating the shaft 27 without imparting any rotation to the shaft 26.

Since the movements of the shafts 26 and 27 are purely rotational, the holes in the cab wall section 10 are effectively sealed by the shafts and their respective support bearings.

I claim:

1. A two-way control lever mounted inside a cab for controlling functions exteriorly of the cab, comprising: said cab having a wall section provided with first and second holes respectively located in first and second vertical planes intersecting within the cab; first and second shafts respectively pivotally mounted in said first and second holes; first and second crank arms respectively fixed to said first and second shafts and having respective portions located for rotation in said second and first planes; and an upright handle having a first lower end portion mounted in said first crank arm for rotation about a first axis located in the second vertical plane and having a second lower end portion mounted in said second crank arm for rotation about a second axis located in the first vertical plane.

2. The control lever defined in claim 1 wherein the first and second crank arms are each in the form of a yoke; and said handle being located centrally between opposite legs of each of the yokes.

* * * * *